US005660096A

United States Patent [19]

Friedrichsen

[11] Patent Number: 5,660,096

[45] Date of Patent: Aug. 26, 1997

[54] CONTROLLED PROPORTIONAL VALVE

[75] Inventor: Welm Friedrichsen, Nordborg, Denmark

[73] Assignee: Danfoss A/S, Nordborg, Denmark

[21] Appl. No.: 454,321

[22] PCT Filed: Nov. 30, 1993

[86] PCT No.: PCT/DK93/00388

§ 371 Date: Jun. 2, 1995

§ 102(e) Date: Jun. 2, 1995

[87] PCT Pub. No.: WO94/13524

PCT Pub. Date: Jun. 23, 1994

[30] Foreign Application Priority Data

Dec. 11, 1992 [DE] Germany ..... 42 41 848.8

[51] Int. Cl.[6] ..... F15B 11/10

[52] U.S. Cl. ..... 91/433; 91/446

[58] Field of Search ..... 91/433, 446, 447

[56] References Cited

U.S. PATENT DOCUMENTS 4,020,867 5/1977 Sumiyoshi ..... 91/433

5,203,678 4/1993 Sugiyama et al. ..... 91/446

FOREIGN PATENT DOCUMENTS 513360 11/1992 European Pat. Off. ..... 60/445

*Primary Examiner*—F. Daniel Lopez

*Attorney, Agent, or Firm*—Lee, Mann, Smith, McWilliams, Sweeney & Ohlson

[57] ABSTRACT

A controlled proportional valve is provided, with a main slide valve section (4) containing a main slide valve, which section controls a flow of fluid between a pump connection (P) connected to a pump (2) and a tank connection (T) connected to a tank (6) and two work connections connected to a load (5) and which generates a load-sensing signal ($LS_{INT}$) in dependence on the pressures at the work connections (A, B), and with a compensating slide valve section (3) which controls the pressure across the main slide valve section (4) in dependence on the load-sensing signal ($LS_{INT}$). It is desirable to achieve a more rapid response time in a proportional valve of that kind, wherein the control means should be capable of being retrofitted to existing proportional valves. To that end, a control arrangement (10) which controls the pressure of the load-sensing signal ($LS_{INT}$) to influence the actual volume flow and/or the actual pressure in the work connections (A, B) is provided.

13 Claims, 1 Drawing Sheet

CONTROLLED PROPORTIONAL VALVE

Figure 1:
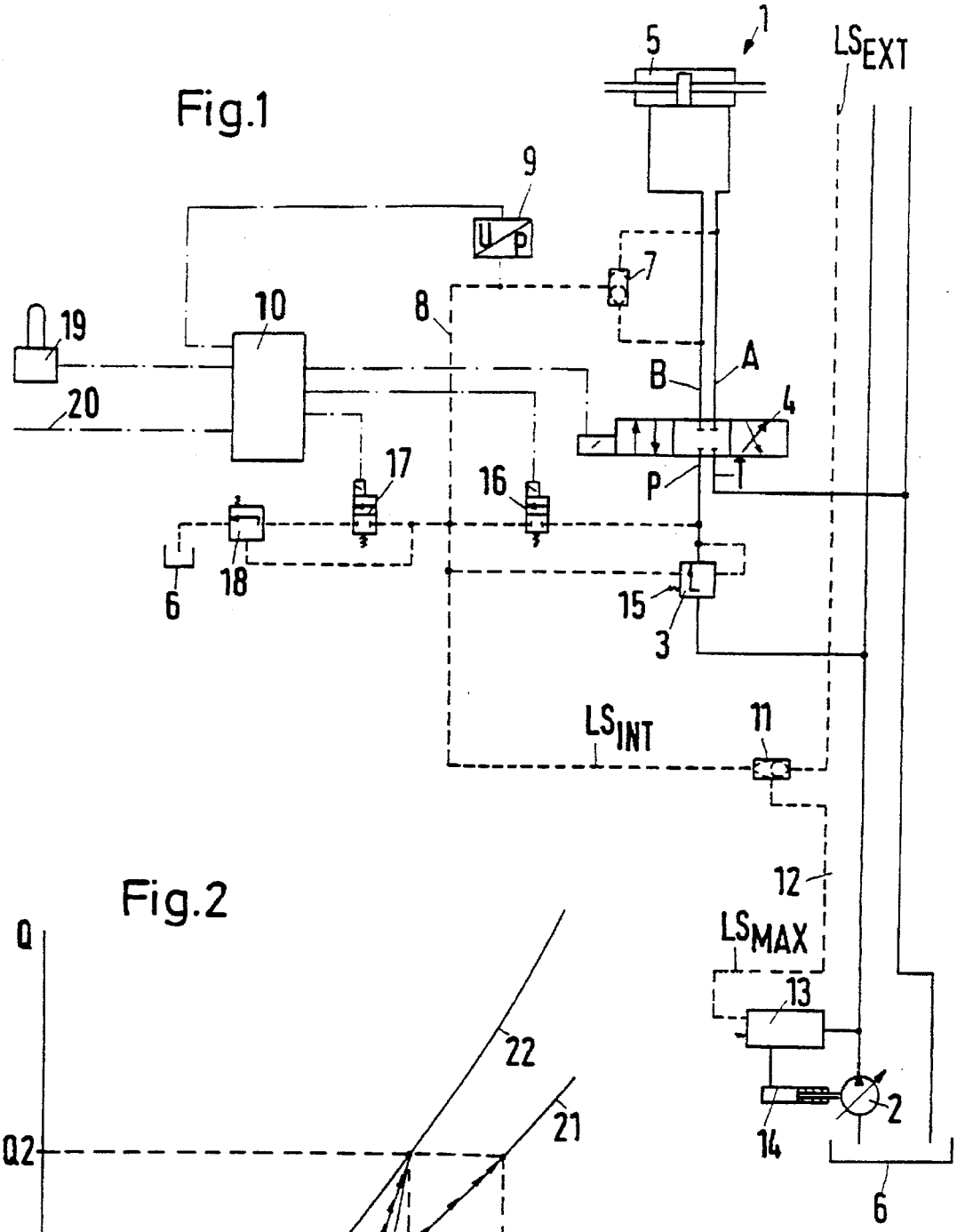

The invention relates to a controlled proportional valve with a main slide valve section containing a main slide valve, which section controls a flow of fluid between a pump connection connected to a pump and a tank connection connected to a tank and two work connections connected to a load and which generates a load-sensing signal in dependence on the pressures at the work connections, and with a compensating slide valve section which controls the pressure across the main slide valve section in dependence on the load-sensing signal.

EP 0 411 151 A1 describes a proportional valve of that kind in which the load-sensing signal acts on one side of a compensating slide valve. The pump pressure also acts on that side. The pressure at the output of the compensating slide valve and an auxiliary pressure changeable between two positions acts on the opposite side of the compensating slide valve. This creates a constant pressure drop across the main slide valve section. This pressure drop can be changed over between two fixed values. In one case, the main slide valve section operates normally. In the other case, because of a relatively small pressure drop a more precise control is possible, since a more substantial change in the position of the main slide valve must then be made to achieve the same change in the volume flow in the work connections. The load-sensing signal is also additionally fed to a controller, which controls the output of the pump.

DE 34 36 246 C2 discloses a control arrangement for a hydraulically operated load, in which the load-sensing signal is no longer solely dependent on the pressure in the work connections, but is formed partly by the loading pressure and partly by the compensating pressure, that is, the pressure at the output of the compensating slide valve. In the event of fluctuations in the loading, the volume flow is then no longer held constant but drops as the loading increases and increases as the loading decreases. It is intended in this manner to achieve a more rapid damping of the fluctuations. The pressure of the load-sensing signal is produced by a pressure divider, the throttle of which is manually adjustable, in order to be able to achieve optimal adaptation to each given individual case.

JP 2 262 473 A (Abstract) discloses a hydraulic circuit in which a compensating slide valve is also controlled in dependence on a load-sensing signal. This load-sensing signal is also responsible for regulating the pump output. Part of the load-sensing signal can be tapped off and supplied to the other side of the compensating slide valve.

The present invention is based on the problem of achieving rapid response of the proportional valve, wherein it is desirable for the control means used for that purpose to be capable of being retrofitted in existing proportional valves.

This problem is solved in a controlled proportional valve of the kind mentioned in the introduction in that a control arrangement which controls the pressure of the load-sensing signal to influence the actual volume flow and/or the actual pressure in the work connections is provided.

By changing the load-sensing signal, the differential pressure across the main slide valve section can be influenced. In this way, the volume flow through the main slide valve section is influenced, without the position of the main slide valve having to be changed. Of course, the volume flow can also still be influenced by a change in the position of the main slide valve. Thus, instead of a characteristic that indicates the dependency of the volume flow on the position of the main slide valve, a working range or characteristic range is obtained, since, in addition to the opening formed by the main slide valve, the pressure can also be used for control of the volume flow. When the volume flow requirement is small, the differential pressure across the main slide valve section can be reduced, which results in a marked reduction in power loss and thus in an increase in efficiency. When a higher volume flow is required, it was previously necessary to shift the main slide valve. But because the main slide valve has a relatively large mass, its mass inertia prevents a very rapid reaction. This disadvantage can now be overcome since the differential pressure across the main slide valve can be increased very much more quickly so that a rapid change in volume flow is possible. Because the new control arrangement enables the differential pressure across the main slide valve to be increased, existing proportional valves can also be brought up to a substantially higher nominal volume flow. This is especially advantageous when a large volume flow requirement occurs only briefly.

Advantageously, the control arrangement detects fluctuations in the pressure in the work connections and controls the load-sensing signal in counter-phase to these fluctuations. Such fluctuations are almost inevitable in hydraulic systems since hydraulic systems frequently operate with flexible hoses, which yield slightly under sudden pressure change and then regain their initial dimension. Such sudden pressure changes can occur, for example, when loads have to be braked as they are lowered. It was previously not possible to compensate for fluctuations because the inertia of the main slide valve was too great to be able to follow the rapid fluctuations. The change in the load-sensing signal in counter-phase now enables the pressure across the main slide valve section to be changed, likewise in counter-phase to the pressure fluctuations in the work connections, which leads to very rapid damping of these fluctuations.

For that purpose, it is an advantage to provide a pressure-measuring device which detects the pressure of the load-sensing signal. Because the pressure of the load-sensing signal always detects the pressure in the work connections, or rather, the higher of the two pressures in the work connections, this feature is sufficient for the pressure fluctuations to be determined effectively.

In an advantageous embodiment, the control arrangement controls also the main slide valve. Changes in the volume flow can then be achieved not only by changing the pressure across the main slide valve, but also, as previously, by changing the position of the main slide valve. This can be exploited, for example, in that on rapid changes in volume flow the differential pressure across the main slide valve is influenced and on slow changes in volume flow the position of the main slide valve is influenced. The control arrangement is then able to control the volume flow in a relatively large region of the characteristic curve.

It is preferable for the control arrangement to control the stationary differential pressure across the main slide valve section to achieve the smallest possible value for the desired or necessary volume flow. This leads to a considerable reduction in power loss since the pump then has to work only at a correspondingly lower pressure. The smallest possible value need not mean the absolute minimum of the pressure difference. It is quite possible for reserves to be provided so that as a result of a rapid pressure change an equally rapid change in the volume flow can be achieved even downwards.

Preferably, on a change in the volume flow the control arrangement changes firstly the differential pressure across the main slide valve section in the direction of the volume flow change, and then changes the main slide valve and the differential pressure simultaneously, so that, with the volume flow remaining the same, the smallest possible differential pressure across the main slide valve section can be set. This procedure is especially advantageous when a sudden change in volume flow is followed by a period of uniform volume flow. It is then possible on the one hand to exploit the advantages of the rapid change, that is, the rapid control of a disturbance, and also on the other hand to exploit the negligible power loss caused by a slight differential pressure across the main slide valve section.

The control arrangement preferably has a controlled throttling device which connects the load-sensing signal to a pressure source and/or a pressure sink. Connection to the pressure source enables the pressure of the load-sensing signal to be increased. Connection to the pressure sink enables the pressure of the load-sensing signal to be reduced. On an increase in the pressure of the load-sensing signal, simultaneously the pressure difference across the main slide valve section is increased and the volume flow is enlarged with the position of the main slide valve otherwise unchanged. On a drop in the pressure of the load-sensing signal, it is the other way round. Because the load-sensing signal can be changed in both directions, a very wide-ranging control of the volume flow through the main slide valve section is achieved.

For that purpose, the throttling device preferably has a plus throttle for increasing the pressure and a minus throttle for reducing the pressure of the load-sensing signal. A controlled increase in the pressure of the load-sensing signal can be effected using the plus throttle and a controlled reduction of the pressure of the load-sensing signal can be effected using the minus throttle. The pressure of the load-sensing signal thus be adjusted not only to fixed values, for instance the pressure of the pressure source or the pressure of the pressure sink, but also to any values between them. The counter-pressure spring of the compensating slide valve can be made smaller or even be omitted. Control of the differential pressure across the main slide valve section is then effected exclusively under the direction of the control arrangement.

The plus throttle and/or the minus throttle are preferably in the form of pulse width modulated electromagnetic valves. Such valves are very fast. The pressure of the load-sensing signal is therefore very rapidly adjusted, which leads to an equally rapid increase in the pressure difference across the main slide valve. In addition, the technology known from controlling the main slide valve can be used to control the load-sensing signal.

The pressure source is advantageously formed by the pump and the pressure sink by the tank. Neither an additional pressure source nor an additional pressure sink is therefore required. On the contrary, existing arrangements provided in connection with the proportional valve can be used.

Similarly, to improve the working conditions of the minus throttle, in an advantageous embodiment a pressure regulator that limits the differential pressure across the minus throttle to a maximum value can be provided between the valve arrangement and the pressure sink.

In a preferred arrangement, the differential pressure across the main valve can also be controlled either using only the minus throttle and a spring or using only the plus throttle and a spring. When the minus throttle is used, the spring must be stronger than when the plus throttle is used. This means that it is possible to omit the respective other throttle, which contributes to a simpler construction of the proportional valve.

Figure 2:
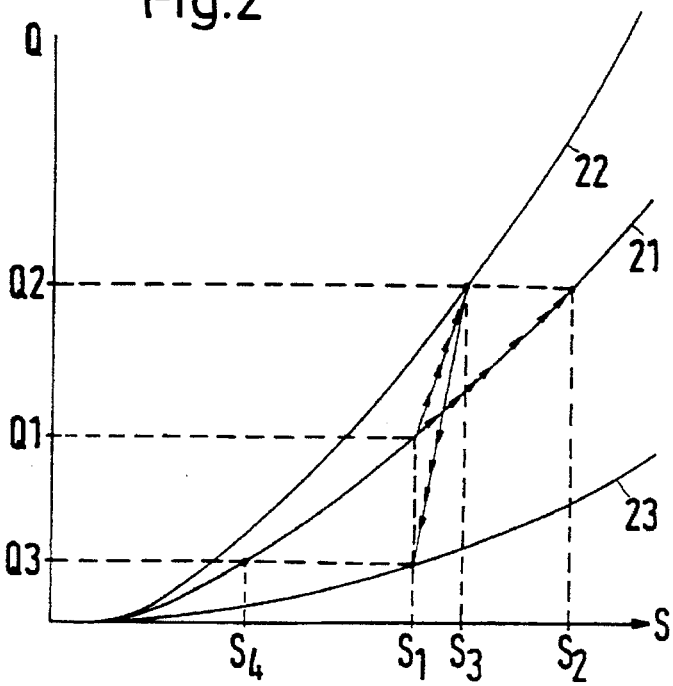

The invention is described hereinafter with reference to a preferred embodiment and in conjunction with the drawings, in which FIG. 1 shows a hydraulic system with control of the proportional valve, and FIG. 2 shows the dependency between the control setting of the main slide valve and the volume flow.

A hydraulic system 1 is provided, in known manner, with a controllable pump 2 which is connected by way of a compensating slide valve section 3 having a compensating slide valve, not illustrated in detail, to a pump connection P of a main slide valve section 4 having a main slide valve, also not illustrated in detail. The compensating slide valve and the main slide valve are known per se, see, for example, DE 34 36 246 C2 or EP 0 411 151 A1.

The main slide valve section 4 has two work connections A, B, via which the main slide valve section 4 is connected to a diagrammatically illustrated load 5, for example a motor. The main slide valve section also has a tank connection T by means of which the hydraulic fluid returning from the load 5 flows into a tank 6 from which the pump 2 is able to remove the hydraulic fluid again.

At the output of a change-over valve 7, the larger of the two pressures of the work connections A and B appears on the line 8. This signal is referred to as a load-sensing signal or load-sensing pressure $LS_{INT}$ and passes to a pressure-measuring device 9 which measures the pressure of the load-sensing signal $LS_{INT}$ and produces from it an electrical signal which it supplies to a control arrangement 10. The pressure-measuring device 9 can be, for example, a pressure-to-voltage transducer. The load-sensing signal $LS_{INT}$ passes by way of a further change-over valve 11, to the other input of which a load-sensing signal $LS_{EXT}$ is fed. At the output of the change-over valve 11, the pressure of the largest of the load-sensing signals is present on the line 12. This signal is referred to as $LS_{MAX}$. The largest of the load-sensing signals $LS_{MAX}$ is supplied to a pump control device 13 which, by means of an actuator 14, controls the pump output in dependence on the largest pressure required in the system.

The compensating slide valve section 3 is biased in one direction by a spring 15. The internal load-sensing pressure $LS_{INT}$ present on the line 8 is applied to the same side. On the opposite side, the output pressure of the compensating slide valve section 3 is fed in, which is at the same time the pressure at the pump connection P of the main slide valve section 4. Thus, without further measures, a pressure difference which is determined by the force of the spring 15 is set across the main slide valve section 4.

The internal load-sensing pressure $LS_{INT}$ fed to the compensating slide valve section may, however, be changed by means of a throttle device which is formed by a plus valve 16 and a minus valve 17. Both valves are clocked electromagnetic valves, that is to say, both the plus valve 16 and the minus valve 17 operate as controllable throttles.

By way of the plus valve 16 the line 8 is connected to the output of the compensating slide valve section 3. The line 8 can then be connected to a pressure source. As the plus valve 16 opens, an increase in the pressure of the internal load-sensing signal $LS_{INT}$ therefore occurs. Of course, it is also possible in principle to connect the plus valve 16 directly to the output of the pump 2. But in that case a relatively large pressure difference would be produced by way of the plus valve 16. For clocked electromagnetic valves, as used for the plus valve 16, a smaller pressure difference is, however, better.

The minus valve 17 connects the line 8 by way of a pressure regulator 18 to the tank 6. The pressure regulator 18 limits the maximum pressure difference across the minus valve 17 to a predetermined maximum value. This leads to more favourable working conditions for the minus valve 17. The plus valve 16, the minus valve 17 and the main slide valve section 4 are controlled by the control arrangement 10 already mentioned. The control arrangement 10 may receive an input signal, for example from an operating device 19, by means of which the volume flow in the load 5 is to be adjusted. It may also receive one or more other external signals which can be supplied by way of an input line 20. Finally, as already mentioned, it can receive an input signal from the pressure-measuring device 9.

The control arrangement 10 detects, for example, fluctuations in the pressure of the internal load-sensing signal $LS_{INT}$. These fluctuations are a sign of fluctuations in the work connections A, B, which can arise, for example, when a load has to be suddenly braked as it is being lowered. The control arrangement 10 can now control the plus valve 16 and the minus valve 17 so that the internal load-sensing signal $LS_{INT}$ fluctuates in counter-phase. This leads to a pressure difference across the main slide valve section 4 fluctuating in counter-phase, whereby fluctuations in the load 5 are very rapidly eliminated. It is not necessary to move the main slide valve for that purpose. It is sufficient when the pressure difference across the main slide valve section is varied. But this is easily possible because of the rapid reaction times of the plus and minus valves 16, 17 and of the compensating slide valve section 3.

The control arrangement 10 can also be used to control the volume flow through the main slide valve section 4. In order to produce a large volume flow as rapidly as possible, the plus valve 16 is opened. The pressure of the internal load-sensing signal $LS_{INT}$ consequently increases. The compensating slide valve of the compensating slide valve section 3 opens. The pressure difference across the main slide valve section 4 increases, whereupon a larger volume flow is produced, without the main slide valve having had to move. Conversely, the volume flow can be reduced just as rapidly by opening the minus valve 17.

This mode of operation is explained with reference to FIG. 2. Here, Q denotes the volume flow through the main slide valve section 4 and S denotes the position of the main slide valve. The curve 21 shows the dependency between the volume flow Q and the positions of the main slide valve for a conventional proportional valve, that is to say, without the control arrangement 10 and the plus and minus valves 16, 17. In the conventional case, to increase the volume flow from a value $Q_1$ to a value $Q_2$ the position of the main slide valve would have to be moved from a position $S_1$ to a position $S_2$. In the system illustrated, the pressure is instead increased across the main slide valve section 4, so that the relationship of the curve 22 is obtained. The position of the main slide valve now needs to be changed only from $S_1$ to $S_3$. It is evident that the main slide valve has to cover a substantially shorter distance. The response time on a increase in volume flow can also be drastically reduced.

Similarly, to reduce the volume flow from a value $Q_2$ to a value $Q_3$, the pressure of the internal load-sensing signal $LS_{INT}$ can be reduced by opening the minus valve 17. The relationship between the position S of the main slide valve and the volume flow Q then follows the curve 23. Here too, the main slide valve has to be moved only from position $S_3$ back to position $S_1$. In the conventional case, it would have to have been moved from position $S_2$ to position $S_4$.

As readily apparent from the last example, it is also possible to change the volume flow without moving the main slide valve at all. This is possible, for example, if it is desired to change the volume flow merely between the two values $Q_1$ and $Q_3$. For that purpose, it is sufficient for the pressure of the internal load-sensing signal $LS_{INT}$ to be changed without having to move the main slide valve of the main slide valve section 4. It is therefore possible also to eliminate fluctuations in the hydraulic system 1, since all that is required is to control the pressure difference across the main slide valve section 4 in counter-phase.

The control arrangement 10 controls not only the plus valve 16 and the minus valve 17, but also the main slide valve section 4. It can therefore adapt the position of the main slide valve to the pressure difference across the main slide valve section 4. For example, it can match both variables to one another such that for a desired or necessary volume flow for the load 5, it is always the smallest pressure difference across the main slide valve section 4 that is produced. This leads to loading on the pump 2 being considerably eased and to negligible power losses. The smallest pressure difference need not mean that the absolute minimum is desired. Reserves of control should be present so that rapid changes in the volume flow can be effected.

Because the control arrangement 10 controls not only the controlled throttling device 16, 17 but also the main slide valve section 4, hybrid modes of adjustment can also be implemented. For example, on a change in volume flow first of all the pressure across the main slide valve section can be changed in the direction of the volume flow change. For example, the pressure difference across the main slide valve section is increased when a larger volume flow is required. Once the larger volume flow has very rapidly been made available, the control arrangement 10 is able to reduce the pressure difference across the main slide valve section 4 and at the same time change the position of the main slide valve, the volume flow being unchanged. It is possible to operate with a small pressure difference across the main slide valve section 4 without having to forgo the advantage of a rapid change in the volume flow.

I claim:

1. A controlled proportional valve having a main slide valve section containing a main slide valve, said section having means to control a flow of fluid between a pump connection connected to a pump and a tank connection connected to a tank and two work connections connected to a load and which generate a load-sensing signal in dependence on pressures at the work connections, a compensating slide valve section having means to control pressure across the main slide valve section in dependence on the load-sensing signal, and including a control arrangement having means to control pressure of the load-sensing signal to influence actual volume flow and/or actual pressure in the work connections.

2. A proportional valve according to claim 1, in which the control arrangement includes means to detect fluctuations in the pressure in the work connections and control the load-sensing signal in counter-phase to these fluctuations.

3. A proportional valve according to claim 2, including a pressure-measuring device having means to detect the pressure of the load-sensing signal.

4. A proportional valve according to claim 1 in which the control arrangement also includes means to control the main slide valve.

5. A proportional valve according to claim 4 in which the control arrangement control means controls stationary differential pressure across the main slide valve section to achieve the smallest possible value for volume flow.

6. A proportional valve according to claim 5, in which, on a change in the volume flow, the control arrangement control means changes firstly differential pressure across the main slide valve section in the direction of volume flow change, and then changes the main slide valve and the differential pressure simultaneously, and, with the volume flow remaining the same, sets the smallest possible differential pressure across the main slide valve section.

7. A proportional valve according to claim 1, in which the control arrangement includes a controlled throttling device having means to connect the load-sensing signal to a pressure source and/or a pressure sink.

8. A proportional valve according to claim 7, in which the pressure source is formed by the pump and the pressure sink by the tank.

9. A proportional valve according to claim 7, in which the throttling device has a plus throttle for increasing the pressure and a minus throttle for reducing the pressure of the load-sensing signal.

10. A proportional valve according to claim 9, in which at least one of the plus throttle and the minus throttle are in the form of a pulse width modulated electromagnetic valve.

11. A proportional valve according to claim 9, including a pressure regulator having means to limit the pressure drop across the minus throttle to a maximum value, said pressure regulator being located between the minus throttle and the pressure sink.

12. A proportional valve according to claim 9, including means to control differential pressure across the slide valve and comprising the minus throttle and a relatively strong spring.

13. A proportional valve according to claim 9, including means to control differential pressure across the main valve and comprising the plus throttle and a relatively weak spring.

* * * * *